US005574418A

United States Patent [19]

Matsumura

[11] Patent Number: 5,574,418

[45] Date of Patent: Nov. 12, 1996

[54] THREE-PHASE AUTOTRANSFORMER WITH A BALANCING FUNCTION

[76] Inventor: Mitsuya Matsumura, 68-2, Oaza, Angyo, Kichizou, Kawaguchi-shi, Saitama, Japan

[21] Appl. No.: 325,940

[22] Filed: Oct. 19, 1994

[30] Foreign Application Priority Data

Oct. 22, 1993 [JP] Japan ..... 5-286145

[51] Int. Cl.[6] ..... H01F 17/02

[52] U.S. Cl. ..... 336/5; 336/155; 336/178

[58] Field of Search ..... 336/5, 148, 213, 336/225; 323/361

[56] References Cited

U.S. PATENT DOCUMENTS 4,766,365 8/1988 Bolduc et al. ..... 336/155

FOREIGN PATENT DOCUMENTS 352129 5/1905 France ..... H01F 17/02
480824 7/1929 Germany ..... H01F 17/02

OTHER PUBLICATIONS

Barry J. Parker et al., Proceedings of the 27th Intersociety Energy Conversion Engineering Conference, vol. 2, Aug. 1992, pp. 2461–2466; 'Electromagnetic Components for Aerospace Electric Power Systems', p. 2465, FIG. 4–6.

Hitachi Seisakusho K.K. et al., Autotransformer With Phase–Shifting Winding, vol. 7, No. 194 (E–195) (1339) Aug. 24, 1983.

*Primary Examiner*—Brian W. Brown
*Assistant Examiner*—G. R. Lord
*Attorney, Agent, or Firm*—Sterne, Kessler, Goldstein & Fox P.L.L.C.

[57] ABSTRACT

A three-phase autotransformer improving balance of three-phase voltages and currents. An iron core has three legs corresponding to the three phase. A common winding and/or a serial winding of each phase includes three coils. Two of the three coils are wound on the same leg associated with the phase of the coils, and the other one coil is wound on another leg. The two coils and the other one coil are connected in series to generate magnetic flux in the opposite directions. Since the common winding and/or the series winding includes coils which are wound on different legs associated with different phases, and which generate flux in opposite directions, the balance of three-phase input voltages and currents, and output voltages and currents is automatically maintained.

9 Claims, 6 Drawing Sheets

THREE-PHASE AUTOTRANSFORMER WITH A BALANCING FUNCTION

BACKGROUND OF THE INVENTION

1. Field of the Invention

The present invention relates to a three-phase autotransformer, and particularly to a three-phase autotransformer with a balancing function which can eliminate imbalance between voltages and currents of the three phases, thereby improving efficiency of electric apparatuses connected to the autotransformer.

2. Description of Related Art

When a conventional three-phase autotransformer is used to supply power to various electric apparatuses connected to its output, imbalance between the three phases may occur.

FIG. 1 is a diagram for illustrating mechanism that causes the imbalance. Three-phase output terminals of a distribution transformer 101 are connected, through distribution lines 102U, 102V and 102W, to the input terminals U, V and W of a three-phase autotransformer 103 including three-phase windings 103U, 103V and 103W which are star-connected. One end of each winding is connected to the neutral point N, which in turn is connected to the neutral point of the distribution transformer 101 through a distribution line 102N. Three-phase output terminals u, v and w are brought out of the windings, and an induction motor M is connected to the output terminals. In addition, an electric heater H is connected between the neutral point N and the output terminal v. The U-phase winding 103U consists of a con, non winding from the neutral point N to the output terminal u, and a series winding from the output terminal u to the input terminal U. Likewise, each of the windings 103V and 103W consists of a common winding from the neutral point to the output terminal, and a series winding from the output terminal to the input terminal.

With this connection, although the induction motor M will keep balance of the three phases, the electric heater H may disturb it, thus causing differences in voltages and currents between the phases. In the case of FIG. 1, for example, the current of the V-phase is greater than the currents of the other phases, which will cause a voltage drop due to a resistance of the distribution line 102V of the V-phase. Thus, imbalance between voltages will occur as well as the imbalance between currents. The imbalance will have various harmful effects on electric apparatuses connected to the transformer. For example, the torque of the induction motor M may be reduced, and its efficiency may be decreased owing to an increase in the slip. In addition, the windings of the induction motor may be overheated, thereby shortening its life.

SUMMARY OF THE INVENTION

It is therefore an object of the present invention to provide a three-phase autotransformer with a balancing function which can reduce imbalance of voltages and currents between the phases.

According to one aspect of the present invention, there is provided a three-phase autotransformer with a balancing function, comprising:

an iron core which includes a first leg, a second leg, and a third leg, which are interlinked;

a first common winding which includes a first winding wound on the first leg, and a second winding wound on the third leg;

a second common winding which includes a third winding wound on the second leg, and a fourth winding wound on the first leg;

a third common winding which includes a fifth winding wound on the third leg, and a sixth winding wound on the second leg;

a first series winding connected in series with the first common winding;

a second series winding connected in series with the second common winding; and a third series winding connected in series with the third common winding, wherein one ends of the first, second and third common windings are connected in common, one ends of the first, second and third series windings are input terminals of a first phase, a second phase, and a third phase, respectively, a connecting point of the first common winding and the first series winding is an output terminal of the first phase, a connecting point of the second common winding and the second series winding is an output terminal of the second phase, and a connecting point of the third common winding and the third series winding is an output terminal of the third phase.

Here, the first winding and the second winding may have the same number of turns, and generate magnetic flux in opposite directions;

the third winding and the fourth winding may have the same number of turns, and generate magnetic flux in opposite directions; and the fifth winding and the sixth winding may have the same number of turns, and generate magnetic flux in opposite directions.

The first series winding may include a seventh winding wound on the first leg, and an eighth winding wound on the third leg;

the second series winding may include a ninth winding wound on the second leg, and a tenth winding wound on the first leg; and the third series winding may include an eleventh winding wound on the third leg, and a twelfth winding wound on the second leg.

The seventh winding and the eighth winding may have the same number of turns, and generate magnetic flux in opposite directions;

the ninth winding and the tenth winding may have the same number of turns, and generate magnetic flux in opposite directions; and the eleventh winding and the twelfth winding may have the same number of turns, and generate magnetic flux in opposite directions.

The first common winding may comprise a first coil wound on the first leg, a second coil wound on the third leg, and a third coil wound on the first leg, the first coil and the third coil having the number of turns of N (N is a positive integer) and generating flux in the same direction, and the second coil having the number of turns of 2N and generating flux in the direction opposite to that of the flux of the first coil;

the second common winding may comprise a fourth coil wound on the second leg, a fifth coil wound on the first leg, and a sixth coil wound on the second leg, the fourth coil and the sixth coil having the number of turns of N and generating flux in the same direction, and the fifth coil having the number of turns of 2N and generating flux in the direction opposite to that of the flux of the fourth coil; and the third common winding may comprise a seventh coil wound on the third leg, an eighth coil wound on the second leg, and a ninth coil wound on the third leg, the seventh coil and the ninth coil having the number of turns of N and generating flux in the same direction, and the eighth coil having the number of turns of 2N and generating flux in the direction opposite to that of the flux of the seventh coil.

The first series winding may comprise a tenth coil wound on the first leg, an eleventh coil wound on the third leg, and a twelfth coil wound on the first leg, the tenth coil and the twelfth coil having the number of turns of M (M is a positive integer) and generating flux in the same direction, and the eleventh coil having the number of turns of 2M and generating flux in the direction opposite to that of the flux of the first coil;

the second series winding may comprise a thirteenth coil wound on the second leg, a fourteenth coil wound on the first leg, and a fifteenth coil wound on the second leg, the thirteenth coil and the fifteenth coil having the number of turns of M and generating flux in the same direction, and the fourteenth coil having the number of turns of 2M and generating flux in the direction opposite to that of the flux of the thirteenth coil; and the third series winding may comprise a sixteenth coil wound on the third leg, a seventeenth coil wound on the second leg, and an eighteenth coil wound on the third leg, the sixteenth coil and the eighteenth coil having the number of turns of M and generating flux in the same direction, and the seventeenth coil having the number of turns of 2M and generating flux in the direction opposite to that of the flux of the sixteenth coil.

According to the present invent ion, the common winding (and/or series winding) of each phase includes not only a coil wound on the leg of its own phase, but also a coil wound on the leg associated with another phase. As a result, even if voltage and current of a particular phase change a great deal, the changes are alleviated. This makes it possible to balance the voltages and currents between the phases, and to achieve efficient operation of electric apparatuses connected to the output of the transformer. In particular, when a three-phase induction motor is connected to the output of the transformer, reduction in torque is prevented, and a regular rotation speed can be achieved. In addition, overheating of coils of the induction motor can be prevented, thereby lengthening its life.

The above and other objects, effects, features and advantages of the present invention will become more apparent from the following description of the embodiment thereof taken in conjunction with the accompanying drawings.

DETAILED DESCRIPTION OF PREFERRED EMBODIMENT

The invention will now be described with reference to the accompanying drawings.

Figure 1:
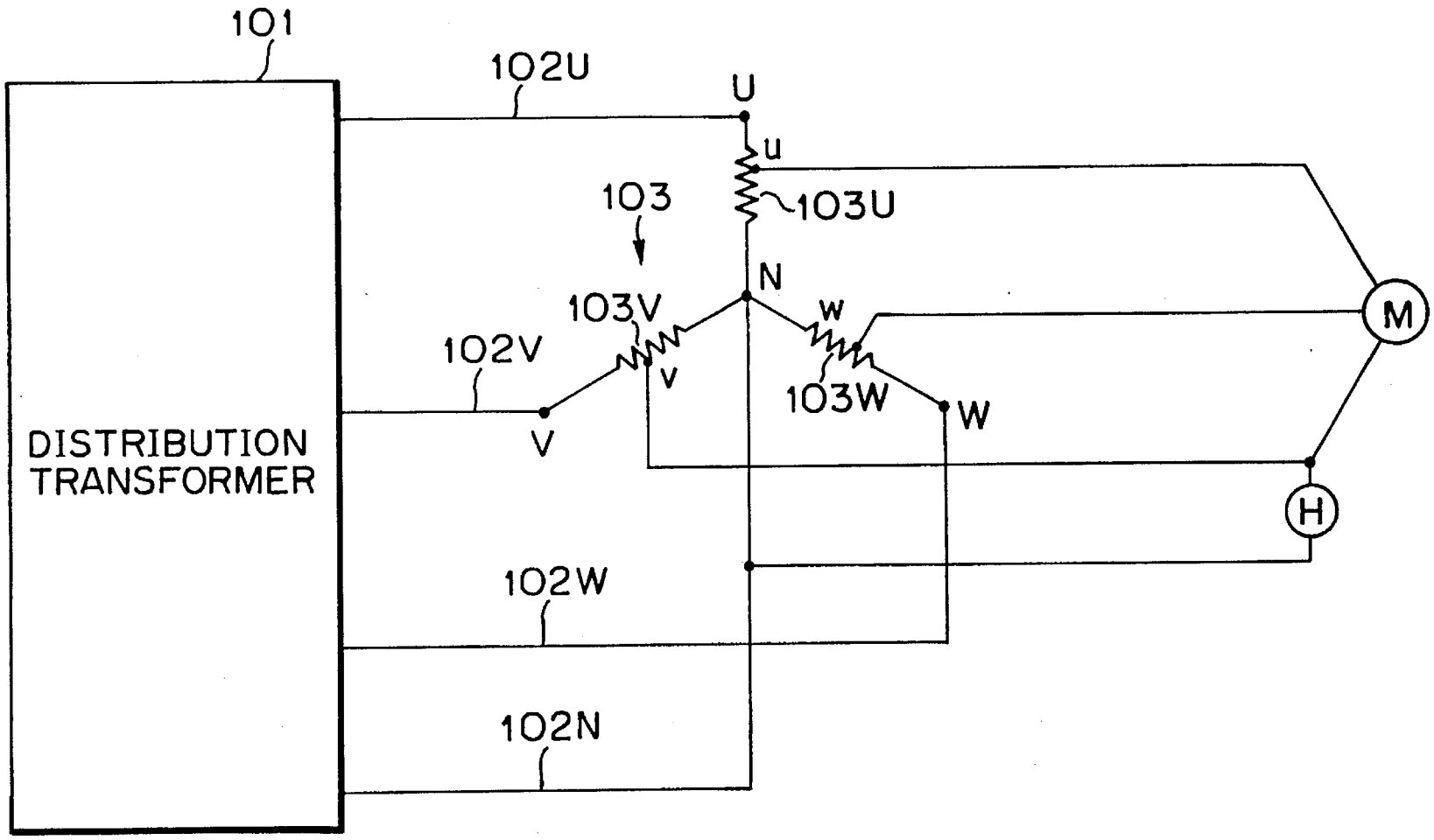
FIG. 1 (PRIOR ART)
FIG. 1 is a connection diagram for explaining the generation mechanism of imbalance of voltages and currents in a conventional three-phase autotransformer.
Figure 2:
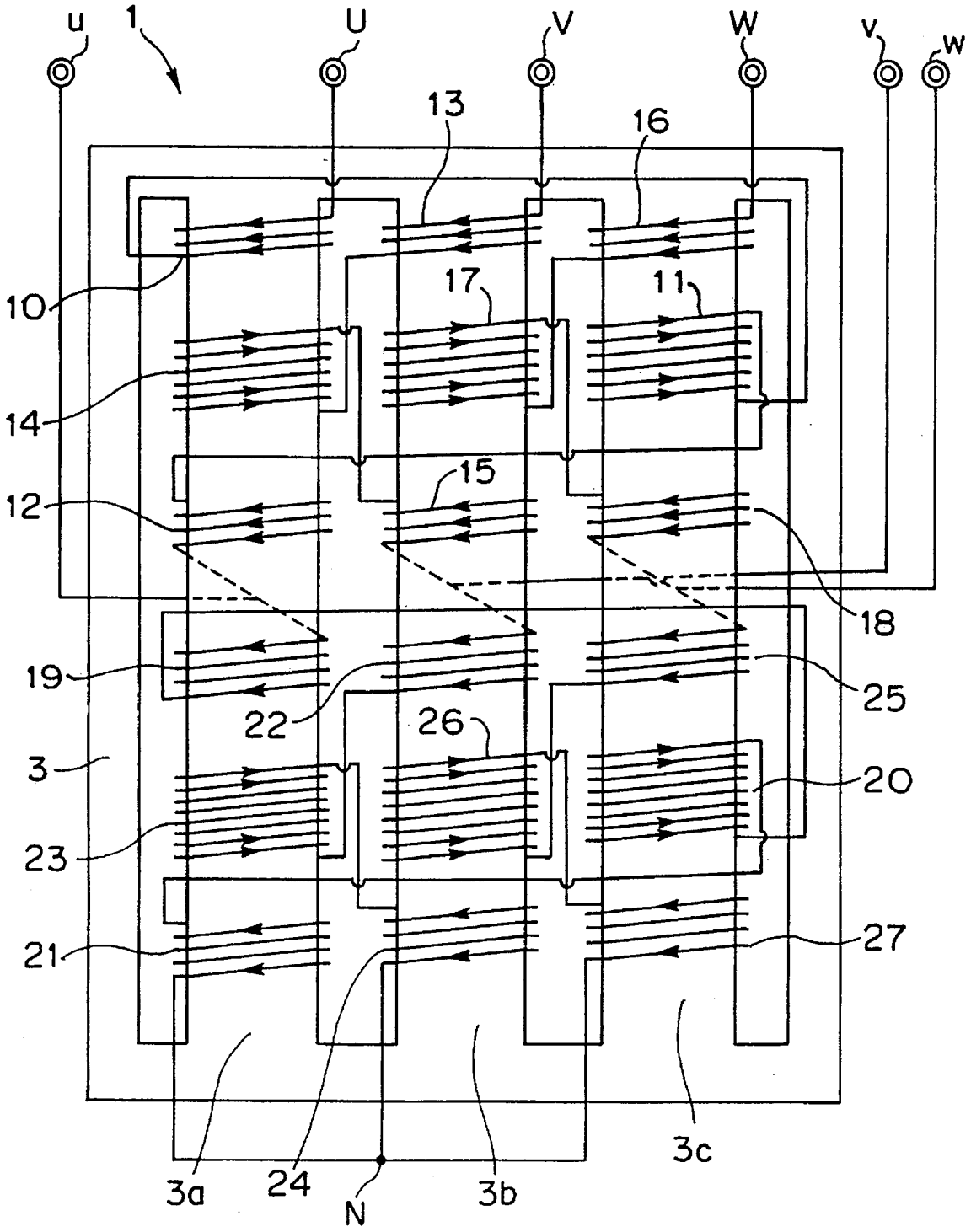
FIG. 2 is a plan view showing an embodiment of a three-phase autotransformer with a balancing function in accordance with the present invent ion.
Figure 3:
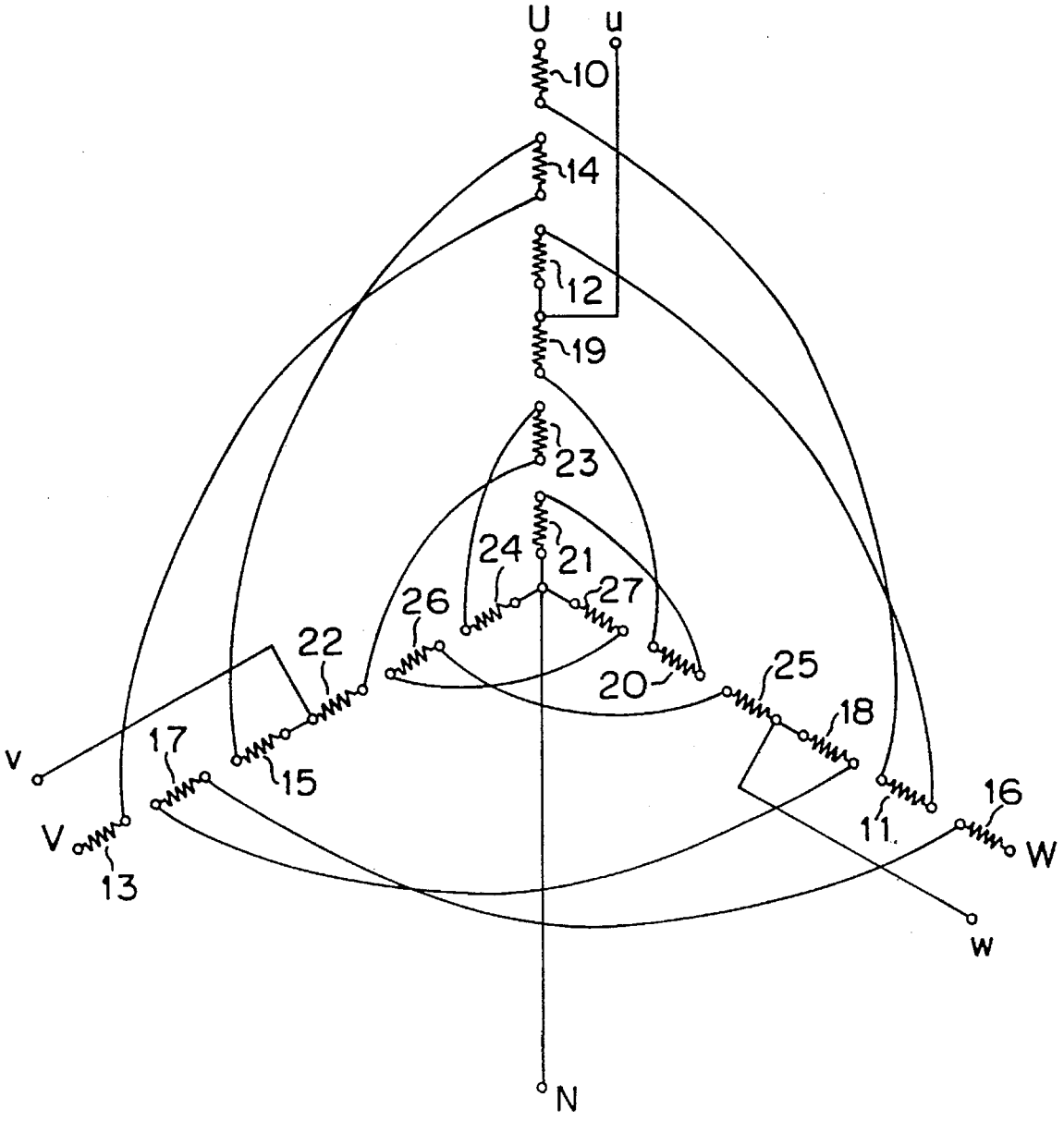
FIG. 3 is a schematic diagram showing the connection in the embodiment shown in FIG. 2.

FIG. 2 shows an embodiment of a three-phase autotransformer with a balancing function in accordance with the present invention, and FIG. 3 illustrates the connection state of the embodiment.

In these figures, a three-phase autotransformer 1 has a shell type iron core 3, which includes a first leg 3*a*, a second leg 3*b* and a third leg 3*c*. In addition, the three-phase autotransformer 1 has input terminals U, V and W, and output terminals u, v and w, which are associated with the three phases.

A series winding of the U-phase includes a coil 10 wound on the first leg 3*a* of the iron core 3, a coil 11 wound on the third leg 3*c*, and a coil 12 wound on the first leg 3*a*, and the coils 10, 11, and 12 are connected in series. The number of turns in the coils 10 and 12 is M (M is a positive integer), and that of the coil 11 is double, that is, 2M. In addition, a current flowing through the coils 10 and 12 induces magnetic flux opposite to the flux induced by a current flowing through the coil 11. In other words, if the coils 10, 11 and 12 are wound in the same direction, and a current flows from the end point to the start point in the coils 10 and 12, the coils 10–12 are connected in such a manner that a current flows from the start point to the end point in the coil 11.

Likewise, a common winding of the U-phase includes a coil 19 wound on the first leg 3*a* of the iron core 3, a coil 20 wound on the third leg 3*c*, and a coil 21 wound on the first leg 3*a*, and the coils 19, 20, and 21 are connected in series. The number of turns in the coils 19 and 21 is N (N is a positive integer), and that of the coil 20 is double, that is, 2N. In addition, a current flowing through the coils 19 and 21 induces magnetic flux opposite to the flux induced by a current flowing through the coil 20.

Series windings and common windings of the other phases are arranged in a similar fashion. Specifically, a series winding of the V-phase includes a coil 13 wound on the second leg 3*b* of the iron core 3, a coil 14 wound on the first leg 3*a*, and a coil 15 wound on the second leg 3*b*, and the coils 13, 14, and 15 are connected in series. The number of turns in the coils 13 and 15 is M, and that of the coil 14 is double, that is, 2M. In addition, a current flowing through the coils 13 and 15 induces magnetic flux opposite to the flux induced by a current flowing through the coil 14.

Likewise, a common winding of the V-phase includes a coil 22 wound on the second leg 3*b* of the iron core 3, a coil 23 wound on the first leg 3*a*, and a coil 24 wound on the second leg 3*b*, and the coils 22, 23, and 24 are connected in series. The number of turns of the coils 22 and 24 is N, and that of the coil 23 is double, that is, 2N. In addition, a current flowing through the coils 22 and 24 induces magnetic flux opposite to the flux induced by a current flowing through the coil 23.

A series winding of the W-phase includes a coil 16 wound on the third leg 3*c* of the iron core 3, a coil 17 wound on the second leg 3*b*, and a coil 18 wound on the third leg 3*c*, and the coils 16, 17, and 18 are connected in series. The number of turns in the coils 16 and 18 is M, and that of the coil 17 is double, that is, 2M. In addition, a current flowing through the coils 16 and 18 induces magnetic flux opposite to the flux induced by a current flowing through the coil 17.

Likewise, a common winding of the W-phase includes a coil 25 wound on the third leg 3*c* of the iron core 3, a coil 26 wound on the second leg 3*b*, and a coil 27 wound on the third leg 3*c*, and the coils 25, 26, and 27 are connected in series. The number of turns of the coils 25 and 27 is N, and that of the coil 26 is double, that is, 2N. In addition, a current flowing through the coils 25 and 27 induces magnetic flux opposite to the flux induced by a current flowing through the coil 26.

The series winding and the common winding of each phase is connected in series, and the output terminals u, v and w are brought out from the connecting points. Furthermore, one ends of the common windings are connected in common to the neutral point N. In this embodiment, the numbers of turns M=2, and N=30.

Figure 4:
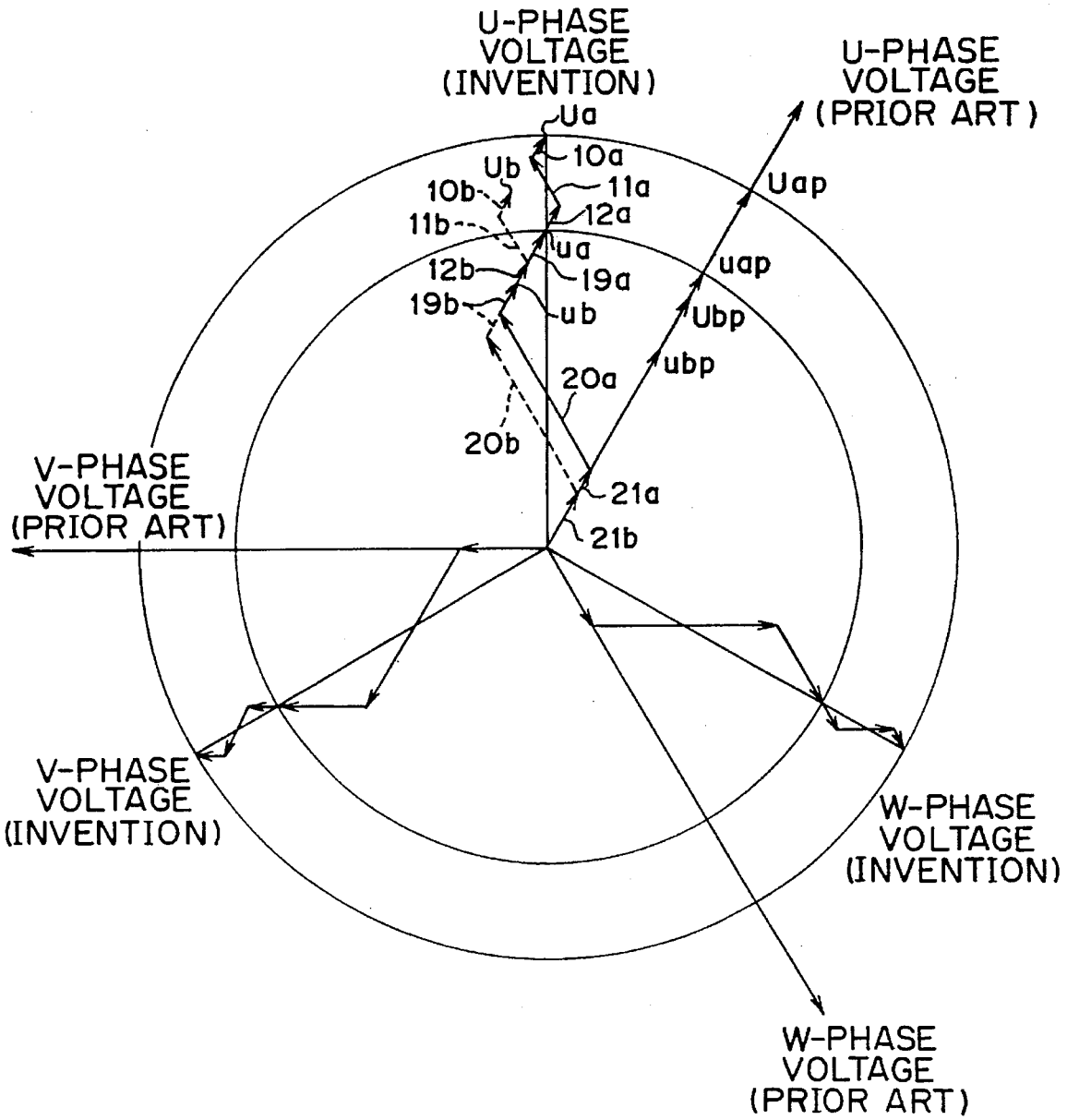
FIG. 4 is a vector diagram illustrating the operation principle of the embodiment shown in FIG. 2.

FIG. 4 is a vector diagram illustrating the operation of the embodiment in comparison with that of a conventional three-phase autotransformer. The vector diagram is made such that it corresponds to the connection diagram of FIG. 3. For example, the reference numeral 21*a* designates a voltage vector of the coil 21 in a rated operation, whereas the reference numeral 20*b* designates a voltage vector of the coil 21 in an imbalance operation.

First, it is assumed that the rated input voltage $U_{ap}$, and the rated output voltage $u_{ap}$ of the U-phase of a conventional autotransformer are as shown in FIG. 4, and that the input voltage is dropped by 30% to $U_{bp}$ of FIG. 4. In the conventional autotransformer, the output voltage will drop in proportion to the input voltage, and take a value $u_{bp}$ of FIG. 4. Such a drop in the U-phase input voltage is caused by a resistance of the distribution line 102U when a large current flows through the line 102U. Although the voltage drop is within 5% in practice, it is assumed to be 30% for the purpose of making the vector diagram clearer.

Let us consider the operation of the present invention under the same conditions. Only, it is further assumed that the input voltage of the W-phase is kept at a rated voltage. When the input voltages of the three phases are rated one, the input voltages and the output voltages will be similar to those of the conventional autotransformer, as indicated by $U_a$ and $u_a$ for the U-phase. More specifically, the output voltage $u_a$ is the vector sum of the voltage vectors 21*a*, 20*a* and 19*a*, due to the common windings 21, 20 and 19, respectively, and the input voltage $U_a$ is the sum of the output voltage $u_a$ and the voltage vectors 12*a*, 11*a* and 10*a*, due to the series windings 12, 11 and 10, respectively.

On the other hand, the U-phase input voltage and u-phase output voltage when the input voltage to the U-phase is dropped by 30% are indicated by $U_b$ and $u_b$ of FIG. 4. More specifically, the output voltage $u_b$ is the vector sum of the voltage vectors 21*b*, 20*b* and 19*b*, due to the common windings 21, 20 and 19, respectively, and the input voltage $U_b$ is the sum of the output voltage $u_b$ and the voltage vectors 12*b*, 11*b* and 10*b*, due to the series windings 12, 11 and 10, respectively. As a result, drops in the input voltage and the output voltage are limited to approximately half of those of the conventional autotransformer, that is, about 15%. The reason for this is that since the coils 20 and 11 are wound on the leg 3*c* associated with the W-phase, the voltages across the coils 20 and 11 are not affected by the drop in the U-phase input voltage as shown in FIG. 4. Since an actual voltage drop is within 5%, the imbalance of actual voltages will be restricted within 2.5%.

Figure 5A:
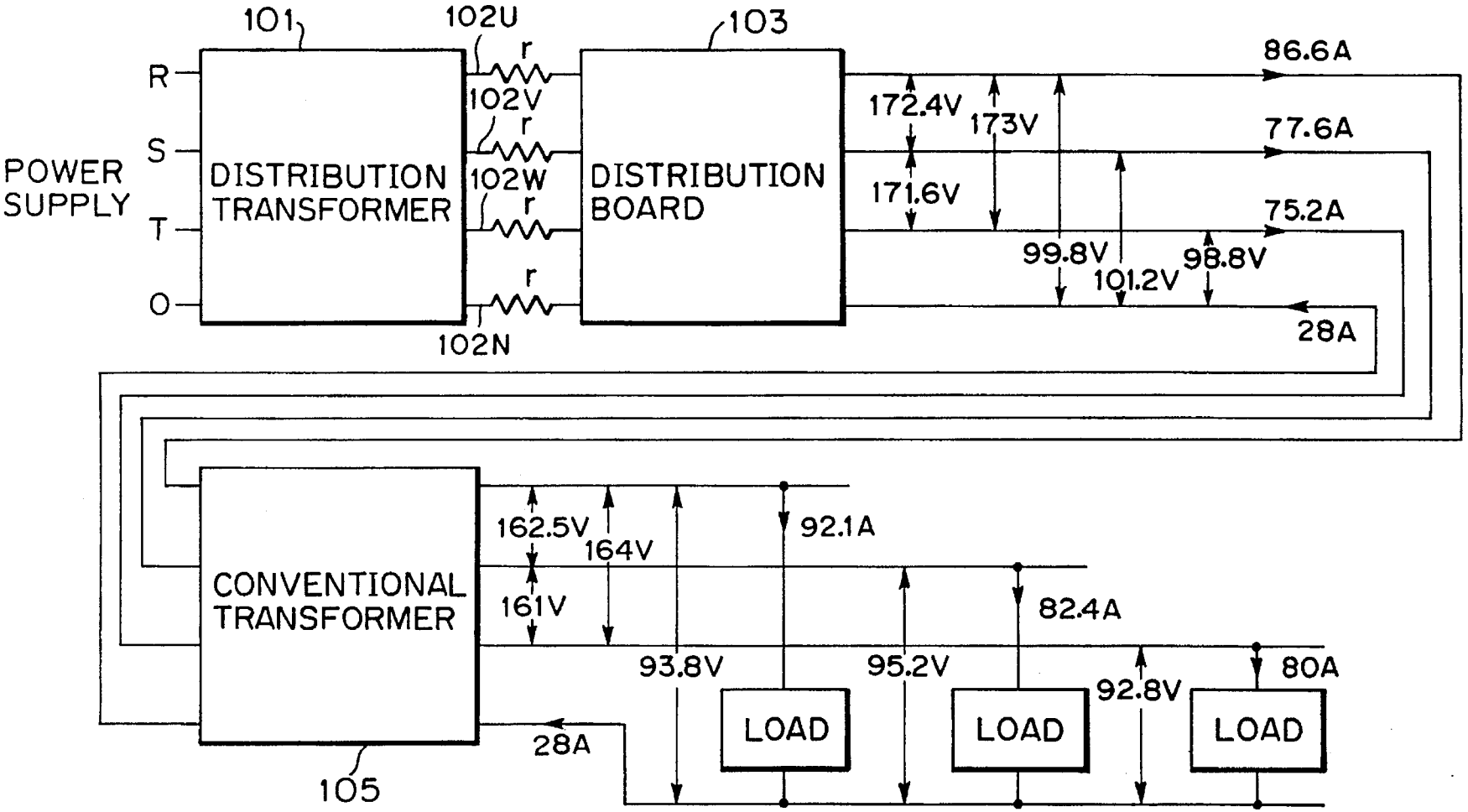
FIG. 5A (PRIOR ART)
FIGS. 5A and 5B are block diagrams illustrating examples of measurement values of a conventional three-phase autotransformer, and those of a three-phase autotransformer with a balancing function in accordance with the present invention, respectively.
Figure 5B:
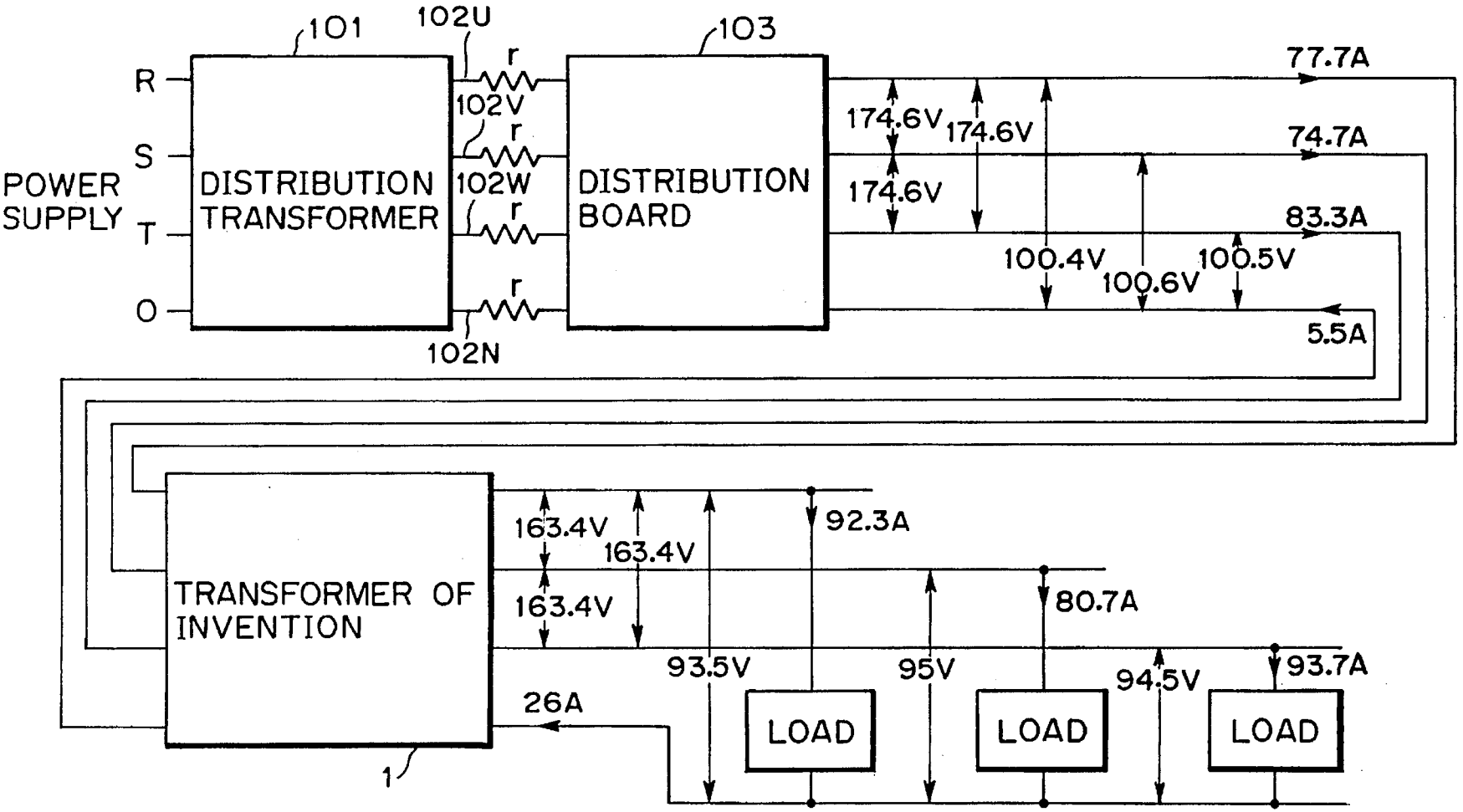

FIG. 5A shows voltages and currents of various portions in a conventional three-phase autotransformer 105, and FIG. 5B shows those in a three-phase autotransformer with a balancing function in accordance with the present invention. As will be seen from these figures, the imbalance between the three-phase input voltages of the conventional device is within 1%, and the imbalance between the single-phase output voltages is within 2.5%. In contrast, the imbalance between the three-phase input voltages and output voltages in the autotransformer in accordance with the present invention is nearly zero. In addition, the imbalance between the single-phase input voltages is nearly zero, and the imbalance between the single-phase output voltages is within 1.6%.

Moreover, the current flowing through the neutral point N is 28 A in the conventional device, whereas that of the autotransformer in accordance with the present invention is 5.5 A, which is much smaller than the conventional value. This proves that the balancing function of the autotransformer in accordance with the present invention works effectively.

Although the turn ratios of the three coils constituting each series winding and common winding are set as 1:2:1 in this embodiment, they are not restricted to the ratios. For example, the series winding or the common winding can be constructed by serially connecting two coils whose turn ratio is 1:1, and which are wound on different legs to induce flux in opposite directions.

The present invention has been described in detail with respect to an embodiment, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A three-phase autotransformer with a balancing function, comprising:

an iron core which includes a first leg, a second leg, and a third leg, which are interlinked;

a first common winding which includes a first winding wound on said first leg, and a second winding wound on said third leg;

a second common winding which includes a third winding wound on said second leg, and a fourth winding wound on said first leg;

a third common winding which includes a fifth winding wound on said third leg, and a sixth winding wound on said second leg;

a first series winding connected in series with said first common winding;

a second series winding connected in series with said second common winding; and a third series winding connected in series with said third common winding, wherein one ends of said first, second and third common windings are connected in common, one ends of said first, second and third series windings are input terminals of a first phase, a second phase, and a third phase, respectively, a connecting point of said first common winding and said first series winding is an output terminal of the first phase, a connecting point of said second common winding and said second series winding is an output terminal of the second phase, and a connecting point of said third common winding and said third series winding is an output terminal of the third phase.

2. The three-phase autotransformer with a balancing function as claimed in claim 1, wherein said first winding and said second winding have the same number of turns, and generate magnetic flux in opposite directions;

said third winding and said fourth winding have the same number of turns, and generate magnetic flux in opposite directions; and said fifth winding and said sixth winding have the same number of turns, and generate magnetic flux in opposite directions.

3. The three-phase autotransformer with a balancing function as claimed in claim 1, wherein said first series winding includes a seventh winding wound on said first leg, and an eighth winding wound on said third leg;

said second series winding includes a ninth winding wound on said second leg, and a tenth winding wound on said first leg; and said third series winding includes an eleventh winding wound on said third leg, and a twelfth winding wound on said second leg.

4. The three-phase autotransformer with a balancing function as claimed in claim 3, wherein said seventh winding and said eighth winding have the same number of turns, and generate magnetic flux in opposite directions;

said ninth winding and said tenth winding have the same number of turns, and generate magnetic flux in opposite directions; and said eleventh winding and said twelfth winding have the same number of turns, and generate magnetic flux in opposite directions.

5. The three-phase autotransformer with a balancing function as claimed in claim 2, wherein said first series winding includes a seventh winding wound on said first leg, and an eighth winding wound on said third leg;

said second series winding includes a ninth winding wound on said second leg, and a tenth winding wound on said first leg; and said third series winding includes an eleventh winding wound on said third leg, and a twelfth winding wound on said second leg.

6. The three-phase autotransformer with a balancing function as claimed in claim 5, wherein said seventh winding and said eighth winding have the same number of turns, and generate magnetic flux in opposite directions;

said ninth winding and said tenth winding have the same number of turns, and generate magnetic flux in opposite directions; and said eleventh winding and said twelfth winding have the same number of turns, and generate magnetic flux in opposite directions.

7. The three-phase autotransformer with a balancing function as claimed in claim 1, wherein said first common winding comprises a first coil wound on said first leg, a second coil wound on said third leg, and a third coil wound on said first leg, said first coil and said third coil having the number of turns of N (N is a positive integer) and generating flux in the same direction, and said second coil having the number of turns of 2N and generating flux in the direction opposite to that of the flux of said first coil;

said second common winding comprises a fourth coil wound on said second leg, a fifth coil wound on said first leg, and a sixth coil wound on said second leg, said fourth coil and said sixth coil having the number of turns of N and generating flux in the same direction, and said fifth coil having the number of turns of 2N and generating flux in the direction opposite to that of the flux of said fourth coil; and said third common winding comprises a seventh coil wound on said third leg, an eighth coil wound on said second leg, and a ninth coil wound on said third leg, said seventh coil and said ninth coil having the number of turns of N and generating flux in the same direction, and said eighth coil having the number of turns of 2N and generating flux in the direction opposite to that of the flux of said seventh coil.

8. The three-phase autotransformer with a balancing function as claimed in claim 1, wherein said first series winding comprises a tenth coil wound on said first leg, an eleventh coil wound on said third leg, and a twelfth coil wound on said first leg, said tenth coil and said twelfth coil having the number of turns of M (M is a positive integer) and generating flux in the same direction, and said eleventh coil having the number of turns of 2M and generating flux in the direction opposite to that of the flux of said first coil;

said second series winding comprises a thirteenth coil wound on said second leg, a fourteenth coil wound on said first leg, and a fifteenth coil wound on said second leg, said thirteenth coil and said fifteenth coil having the number of turns of M and generating flux in the same direction, and said fourteenth coil having the number of turns of 2M and generating flux in the direction opposite to that of the flux of said thirteenth coil; and said third series winding comprises a sixteenth coil wound on said third leg, a seventeenth coil wound on said second leg, and an eighteenth coil wound on said third leg, said sixteenth coil and said eighteenth coil having the number of turns of M and generating flux in the same direction, and said seventeenth coil having the number of turns of 2M and generating flux in the direction opposite to that of the flux of said sixteenth coil.

9. The three-phase autotransformer with a balancing function as claimed in claim 7, wherein said first series winding comprises a tenth coil wound on said first leg, an eleventh coil wound on said third leg, and a twelfth coil wound on said first leg, said tenth coil and said twelfth coil having the number of turns of M (M is a positive integer) and generating flux in the same direction, and said eleventh coil having the number of turns of 2M and generating flux in the direction opposite to that of the flux of said first coil;

said second series winding comprises a thirteenth coil wound on said second leg, a fourteenth coil wound on said first leg, and a fifteenth coil wound on said second leg, said thirteenth coil and said fifteenth coil having the number of turns of M and generating flux in the same direction, and said fourteenth coil having the number of turns of 2M and generating flux in the direction opposite to that of the flux of said thirteenth coil; and said third series winding comprises a sixteenth coil wound on said third leg, a seventeenth coil wound on said second leg, and an eighteenth coil wound on said third leg, said sixteenth coil and said eighteenth coil having the number of turns of M and generating flux in the same direction, and said seventeenth coil having the number of turns of 2M and generating flux in the direction opposite to that of the flux of said sixteenth coil.

* * * * *